US008851318B1

(12) United States Patent
Sherman

(10) Patent No.: US 8,851,318 B1
(45) Date of Patent: Oct. 7, 2014

(54) PAINTING TRAY

(71) Applicant: Michael Sherman, Mooresville, NC (US)

(72) Inventor: Michael Sherman, Mooresville, NC (US)

(73) Assignee: Zibra, LLC, Mooresville, NC (US)

( * ) Notice: Subject to any disclaimer, the term of this patent is extended or adjusted under 35 U.S.C. 154(b) by 0 days.

(21) Appl. No.: 13/844,715

(22) Filed: Mar. 15, 2013

(51) Int. Cl.
*B05C 21/00* (2006.01)
*B44D 3/12* (2006.01)

(52) U.S. Cl.
CPC ..... *B05C 21/00* (2013.01); *B44D 3/128* (2013.01); *B44D 3/126* (2013.01)
USPC ..... 220/570

(58) Field of Classification Search
CPC ..... B44D 3/126; B44D 3/125; B44D 3/122; B44D 3/04; B44D 3/02; B44D 3/128
USPC ..... 220/570, 736, 735, 702, 701, 700, 699, 220/698, 697, 695, 694, 731, 733; 206/575, 206/1.9, 1.8, 1.7
See application file for complete search history.

(56) References Cited

U.S. PATENT DOCUMENTS 1,979,241 A 11/1934 Albanese et el.
1,994,335 A * 3/1935 Churan ..... 220/701
2,207,210 A * 7/1940 Von Knauf ..... 220/799
2,566,877 A * 9/1951 Dunton ..... 220/736
3,593,880 A * 7/1971 Kulbacki ..... 220/697
4,832,293 A * 5/1989 Gizzi ..... 248/110
5,103,999 A * 4/1992 Elliott et al. ..... 220/570
5,609,322 A * 3/1997 Bond ..... 248/558
6,102,235 A * 8/2000 Stern et al. ..... 220/212
6,332,556 B1 * 12/2001 Shalman ..... 220/570
D457,995 S 5/2002 Clark
D481,502 S 10/2003 Clark
6,681,952 B2 1/2004 Mowe
7,484,637 B2 * 2/2009 Cutler et al. ..... 220/570
D629,986 S 12/2010 Clark
D652,597 S 1/2012 Clark, Jr.

* cited by examiner

*Primary Examiner* — Robert J Hicks
(74) *Attorney, Agent, or Firm* — Tillman Wright, PLLC; Chad D. Tillman; Jeremy C. Doerre

(57) ABSTRACT

A paint tray includes a body having a base portion and sidewalls forming a paint well. Each sidewall has an upper top portion. The upper top portions collectively define an upper rim of a mouth of the well. A barred shaped member is hingedly connected to the upper top portion of a first sidewall such that the barred shaped member pivots relative to the body between first and second positions. In the first position, the barred shaped member is disposed within and surrounded by an inner perimeter of the upper rim of the mouth of the paint well. In the second position, the barred shaped member extends away from the upper rim and neither extends over nor within the mouth of the paint well. The paint tray is fabricated out of a molded material, and preferably comprises molded plastic.

18 Claims, 2 Drawing Sheets

PAINTING TRAY

COPYRIGHT STATEMENT

All of the material in this patent document is subject to copyright protection under the copyright laws of the United States and other countries. The copyright owner has no objection to the facsimile reproduction by anyone of the patent document or the patent disclosure, as it appears in official governmental records but, otherwise, all other copyright rights whatsoever are reserved.

BACKGROUND OF THE PRESENT INVENTION

The present invention generally relates to a paint tray and, in particular, to a paint tray with a movable bar.

There are a variety of paint trays. A paint tray can be a way for a person to access paint as they are painting. A person's paint brush dipped into paint has the tendency to contain excess paint. If the excess paint is not scraped off of the brush, the paint may drip. Furthermore, as a painter uses a paint brush, excess paint tends to dry on the brush. Some painters also have the tendency to scrape a paint brush on the side of a paint tray to remove excess paint or dried paint from the brush.

Accordingly, it is believed that a need exists for improvements in paint trays.

SUMMARY OF THE INVENTION

The present invention broadly relates to a paint tray and, in particular, to a paint tray with a pivotable paint bar.

In a broad embodiment of the invention, a paint tray for use while painting includes a body, a base portion, and sidewalls having upper top portions, wherein the sidewalls are attached to the sides of a base portion and form a well for holding paint. The paint tray includes a paint bar hingedly connected to one of the upper top portions that pivots relative to the body of the paint tray.

In addition to the disclosed aspects and features of the present invention, it should be noted that the present invention further encompasses the various possible combinations and subcombinations of such aspects and features. Thus, for example, any aspect may be combined with any feature in accordance with the present invention without requiring any other aspect or feature.

BRIEF DESCRIPTION OF THE DRAWINGS

Further features, embodiments, and advantages of the present invention will become apparent from the following detailed description with reference to the drawings, wherein.

DETAILED DESCRIPTION

Figure 1:
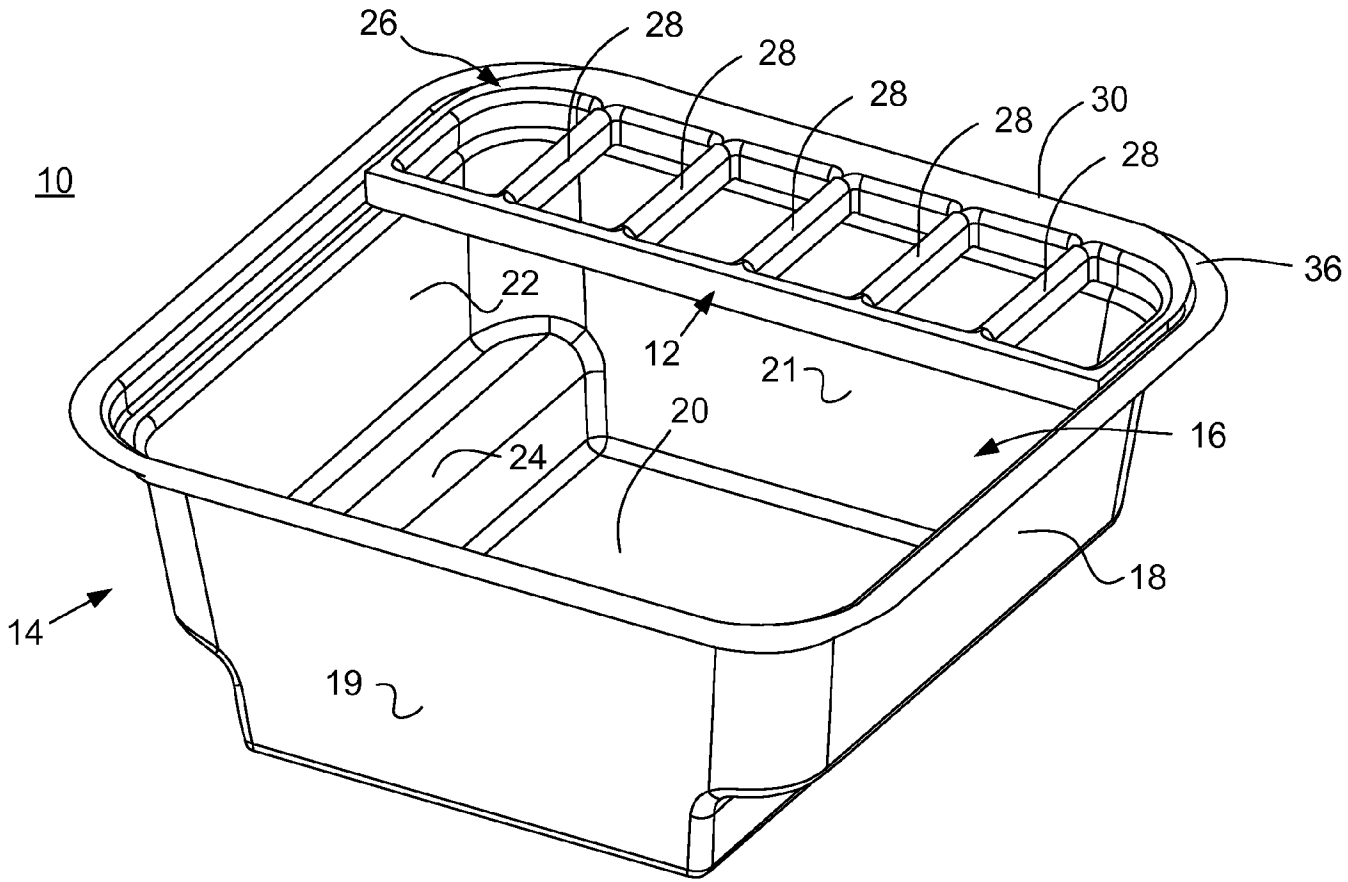
FIG. 1 is a perspective view of a paint tray in accordance with one or more preferred embodiments of the present invention.

As a preliminary matter, it will readily be understood by one having ordinary skill in the relevant art ("Ordinary Artisan") that the present invention has broad utility and application. Furthermore, any embodiment discussed and identified as being "preferred" is considered to be part of a best mode contemplated for carrying out the present invention. Other embodiments also may be discussed for additional illustrative purposes in providing a full and enabling disclosure of the present invention. As should be understood, any embodiment may incorporate only one or a plurality of the above-disclosed aspects of the invention and may further incorporate only one or a plurality of the above-disclosed features. Moreover, many embodiments, such as adaptations, variations, modifications, and equivalent arrangements, will be implicitly disclosed by the embodiments described herein and fall within the scope of the present invention.

Accordingly, while the present invention is described herein in detail in relation to one or more embodiments, it is to be understood that this disclosure is illustrative and exemplary of the present invention, and is made merely for the purposes of providing a full and enabling disclosure of the present invention. The detailed disclosure herein of one or more embodiments is not intended, nor is to be construed, to limit the scope of patent protection afforded the present invention, which scope is to be defined by the claims and the equivalents thereof. It is not intended that the scope of patent protection afforded the present invention be defined by reading into any claim a limitation found herein that does not explicitly appear in the claim itself.

Thus, for example, any sequence(s) and/or temporal order of steps of various processes or methods that are described herein are illustrative and not restrictive. Accordingly, it should be understood that, although steps of various processes or methods may be shown and described as being in a sequence or temporal order, the steps of any such processes or methods are not limited to being carried out in any particular sequence or order, absent an indication otherwise. Indeed, the steps in such processes or methods generally may be carried out in various different sequences and orders while still falling within the scope of the present invention. Accordingly, it is intended that the scope of patent protection afforded the present invention is to be defined by the appended claims rather than the description set forth herein.

Additionally, it is important to note that each term used herein refers to that which the Ordinary Artisan would understand such term to mean based on the contextual use of such term herein. To the extent that the meaning of a term used herein—as understood by the Ordinary Artisan based on the contextual use of such term—differs in any way from any particular dictionary definition of such term, it is intended that the meaning of the term as understood by the Ordinary Artisan should prevail.

Regarding applicability of 35 U.S.C. §112, ¶ 6, no claim element is intended to be read in accordance with this statutory provision unless the explicit phrase "means for" or "step for" is actually used in such claim element, whereupon this statutory provision is intended to apply in the interpretation of such claim element.

Furthermore, it is important to note that, as used herein, "a" and "an" each generally denotes "at least one," but does not exclude a plurality unless the contextual use dictates otherwise. Thus, reference to "a picnic basket having an apple" describes "a picnic basket having at least one apple" as well as "a picnic basket having apples." In contrast, reference to "a picnic basket having a single apple" describes "a picnic basket having only one apple."

When used herein to join a list of items, "or" denotes "at least one of the items," but does not exclude a plurality of items of the list. Thus, reference to "a picnic basket having cheese or crackers" describes "a picnic basket having cheese without crackers", "a picnic basket having crackers without cheese", and "a picnic basket having both cheese and crackers." Finally, when used herein to join a list of items, "and" denotes "all of the items of the list." Thus, reference to "a picnic basket having cheese and crackers" describes "a picnic basket having cheese, wherein the picnic basket further has crackers," as well as describes "a picnic basket having crackers, wherein the picnic basket further has cheese."

Referring now to the drawings, one or more preferred embodiments of the present invention are next described. The following description of one or more preferred embodiments is merely exemplary in nature and is in no way intended to limit the invention, its implementations, or uses.

Figure 2:
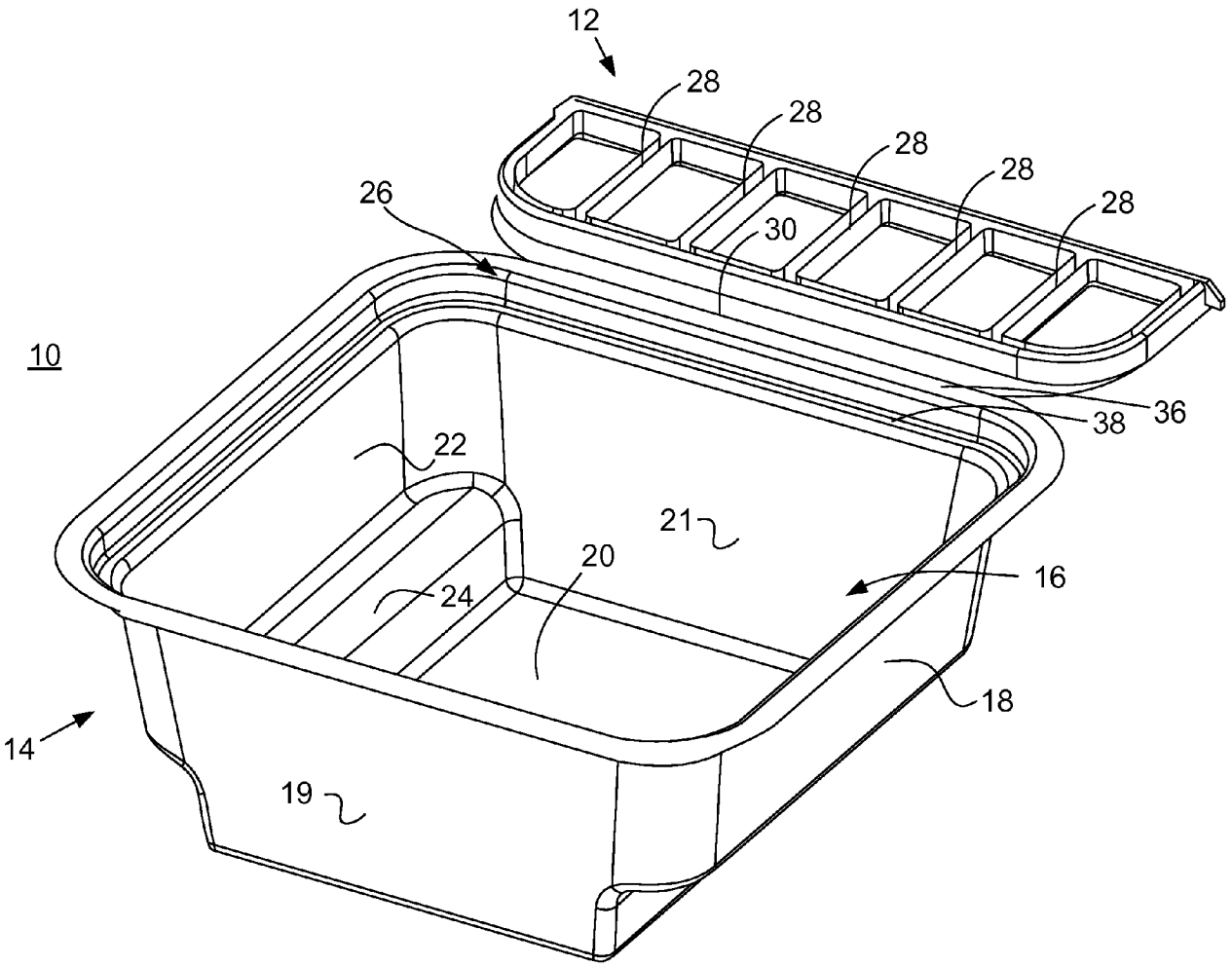
FIG. 2 is another perspective view of the paint tray of FIG. 1.

FIG. 1 is a perspective view of a paint tray 10 in accordance with one or more preferred embodiments of the present invention, shown with paint bar 12 in a first position; and FIG. 2 is a perspective view of the paint tray 10 of FIG. 1 shown with the paint bar 12 in a second position having transitioned by pivoting about a hinge 30 from the first position to the second position, described in further detail below. With continuing reference to FIG. 1, the paint tray 10 includes a substantially square shaped body 14 defining a paint well 16. The paint tray 10 also includes the paint bar 12 that is pivotably movable relative to body 14 about the hinge 30. The paint tray 10 is preferably fabricated out of molded plastic, but other materials can be used, such as a metal material (e.g. aluminum).

The body 14 includes a base portion 20 for supporting the paint tray 10 on the ground. The body 14 further includes four sidewalls 18,19,21,22 connected with and extending upwardly from the base portion 20. The sidewalls 18,19,21, 22 and base portion 20 define a paint well 16. As seen in FIG. 1, sidewall 22 curves in toward paint well 16 forming an internal shelf 24 that may be used to wipe excess paint off of the end of a brush; similarly, opposing sidewall 18 curves too, forming an opposing internal shelf, which is generally hidden in the perspective views of the drawings. The upper edges 26 of at least some of the sidewalls may be curved to provide a location by which the body 14 may be gripped. Further at least one of the upper edges 26 supports a paint bar 12 pivotably movable relative to body 14.

While the body 14 is shown with a generally square shape, it is also within the scope of the present invention for the body 14 to have any of a range of possible shapes and sizes. The paint bar 12 includes a generally rectangular barred shaped body having a plurality of internal bars 28 separated by openings extending therebetween. The internal bars 28 extend from a proximal lateral side of the generally rectangular barred shaped body to a distal lateral side, relative to the hinge 30. The paint bar 12 is connected to an upper rim 36 along one of the sidewalls—upper sidewall 21 as shown in the drawings—by the hinge 30 and is thereby pivotably movable relative to body 14. In particular, the paint bar 12 is configured to be pivotable relative to the body 14 of the paint tray 10 so as to permit transitioning of the paint bar 12 between a closed configuration, as shown in FIG. 1, in which the paint bar 12 rests within and closes over part of the mouth of the paint well 16; and an open configuration, in which the paint bar 12 does not obstruct the mouth of the paint well 16 and extends beyond the rim 36 of the sidewall 21 away from the paint well 16.

It will be appreciated from the drawings that, when in the closed configuration as shown in FIG. 1, the paint bar 12 extends within a first inner perimeter of the upper rim 36 and over a projecting edge 38 of the sidewall 21; and when in the open configuration as shown in FIG. 2, one of the sides of the paint bar 12 and corner edges of the paint bar closely track with the mouth of the paint well 16 along the upper top portion of the sidewall 21 and adjacent upper top portions of sidewalls 18,22.

In use, paint may be poured into the paint well 16 defined by the body 14 of the paint tray 10 with paint bar 12 in the open position of FIG. 2. After pouring paint into the paint well 16, the user may pivot the paint bar 12 to the closed position of FIG. 1. The brush, when dipped into paint, has the tendency to contain excess paint. If the excess paint is not scraped off of the brush, then the paint may drip. A user of paint tray 10 may use the paint bar 12 to scrape the excess paint from a brush. Furthermore, as a painter uses a paint brush, excess paint tends to dry on the brush. A user of paint tray 10 may use the paint bar 12 to scrape the dried paint from the brush. Additionally, a painter may selectively clean the paint bar 12, without the concern of contaminating any paint in the paint well 16, by pivotally moving the paint bar 12 into the open position for cleaning.

Many embodiments and adaptations of the present invention other than those specifically described herein, as well as many variations, modifications, and equivalent arrangements, will be apparent from or reasonably suggested by the present invention and the foregoing descriptions thereof, without departing from the substance or scope of the present invention.

Accordingly, while the present invention has been described herein in detail in relation to one or more preferred embodiments, it is to be understood that this disclosure is only illustrative and exemplary of the present invention and is made merely for the purpose of providing a full and enabling disclosure of the invention. The foregoing disclosure is not intended to be construed to limit the present invention or otherwise exclude any such other embodiments, adaptations, variations, modifications or equivalent arrangements, the present invention being limited only by the claims appended hereto and the equivalents thereof.

What is claimed is:

1. A paint tray, comprising:

(a) a body comprising, (i) a base portion; and (ii) sidewalls connected to the base portion and forming a paint well for holding paint, each of the sidewalls having an upper top portion, the upper top portions collectively defining an upper rim of a mouth of the well; and (b) a barred shaped member hingedly connected to the upper top portion of a first sidewall of the sidewalls such that the barred shaped member is pivotable relative to the body of the paint tray between, (i) a first position, in which the barred shaped member is disposed within and surrounded by an inner perimeter of the upper rim of the mouth of the paint well; and (ii) a second position, in which the barred shaped member extends away from the upper rim of the mouth of the paint well and neither extends over nor within the mouth of the paint well;

(c) wherein the paint tray is fabricated out of a molded material;

(d) wherein the first sidewall includes an inner projecting edge located proximate the upper top portion thereof, and wherein the barred shaped member extends over the inner projecting edge of the first sidewall when in the first position.

2. The paint tray of claim 1, wherein the paint tray consists of molded plastic.

3. The paint tray of claim 1, wherein the barred shaped member rests on the inner projecting edge when in the first position.

4. A paint tray, comprising:

(a) a body comprising, (i) a base portion; and (ii) sidewalls connected to the base portion and forming a paint well for holding paint, each of the sidewalls having an upper top portion, the upper top portions collectively defining an upper rim of a mouth of the well; and (b) a barred shaped member hingedly connected to the upper top portion of a first sidewall of the sidewalls such that the barred shaped member is pivotable relative to the body of the paint tray between, (i) a first position, in which the barred shaped member is disposed within and surrounded by an inner perimeter of the upper rim of the mouth of the paint well; and (ii) a second position, in which the barred shaped member extends away from the upper rim of the mouth of the paint well and neither extends over nor within the mouth of the paint well;

(c) wherein the paint tray is fabricated out of a molded material;

(d) wherein the upper top portions of the sidewalls each includes an inner projecting edge, the collective inner projecting edges of the sidewalls forming an inner rim having a second, inner perimeter that is less than the first inner perimeter of the upper rim.

5. The paint tray of claim 4, wherein the barred shaped member rests upon the inner rim when in the first position.

6. The paint tray of claim 1, wherein the barred shaped member comprises a series of bars each extending between a proximal lateral side of the barred shaped member and a distal lateral side of the barred shaped member.

7. The paint tray of claim 6, wherein the barred shaped member has a total of five bars and six openings.

8. A tray comprising:

(a) a body comprising, (i) a base portion, and (ii) sidewalls extending upwardly from the base portion, the sidewalls including (A) upper surfaces collectively defining an upper rim having a first inner perimeter, the upper rim defining an opening into a well collectively defined by the base and the sidewalls, and (B) protruding portions proximate a top of the sidewalls, the protruding portions collectively defining a protruding ring extending inwardly from the sidewalls that has a second inner perimeter that is less than the first inner perimeter, and (b) a barred shaped member comprising a plurality of generally parallel bars disposed generally perpendicular to a lengthwise direction of the barred shaped member, the plurality of generally parallel bars defining a plurality of openings through the barred shaped member;

(c) wherein the barred shaped member is pivotally connected to an upper portion of the body such that the paint tray is transitionable between (i) a first position, in which the barred shaped member is disposed generally within the opening of the well and rests on one or more portions of an upper surface of the protruding ring whereby the barred shaped member is suspended over any paint disposed within the well, and (ii) a second position, in which the barred shaped member does not extend over the opening of the well.

9. The tray of claim 8, wherein the tray is fabricated out of a molded material.

10. The tray of claim 9, wherein the tray consists of molded plastic.

11. The tray of claim 8, wherein the barred shaped member has a total of five bars and six openings.

12. A method of making a paint tray, comprising molding the paint tray from a material such that the paint tray comprises, (a) a body comprising, (i) a base portion; and (ii) sidewalls connected to the base portion and forming a paint well for holding paint, each of the sidewalls having an upper top portion, the upper top portions collectively defining an upper rim of a mouth of the well; and (b) a barred shaped member hingedly connected to the upper top portion of a first sidewall of the sidewalls such that the barred shaped member is pivotable relative to the body of the paint tray between, (i) a first position, in which the barred shaped member is disposed within and surrounded by an inner perimeter of the upper rim of the mouth of the paint well; and (ii) a second position, in which the barred shaped member extends away from the upper rim of the mouth of the paint well and neither extends over nor within the mouth of the paint well;

(c) wherein the first sidewall is molded to include an inner projecting edge located proximate the upper top portion thereof, and wherein the barred shaped member extends over the inner projecting edge of the first sidewall when in the first position.

13. The method of claim 12, wherein the paint tray is molded from plastic.

14. The method of claim 12, wherein the barred shaped member is molded so as to rest on the inner projecting edge when in the first position.

15. A method of making a paint tray, comprising molding the paint tray from a material such that the paint tray comprises, (a) a body comprising, (i) a base portion; and (ii) sidewalls connected to the base portion and forming a paint well for holding paint, each of the sidewalls having an upper top portion, the upper top portions collectively defining an upper rim of a mouth of the well; and (b) a barred shaped member hingedly connected to the upper top portion of a first sidewall of the sidewalls such that the barred shaped member is pivotable relative to the body of the paint tray between, (i) a first position, in which the barred shaped member is disposed within and surrounded by an inner perimeter of the upper rim of the mouth of the paint well; and (ii) a second position, in which the barred shaped member extends away from the upper rim of the mouth of the paint well and neither extends over nor within the mouth of the paint well;

(c) wherein the upper top portions of the sidewalls are molded to each include an inner projecting edge, the collective inner projecting edges of the sidewalls forming an inner rim having a second, inner perimeter that is less than the first inner perimeter of the upper rim.

16. The method of claim 15, wherein the barred shaped member is molded to rest upon the inner rim when in the first position.

17. The method of claim 12, wherein the barred shaped member is molded to comprise a series of bars each extending between a proximal lateral side of the barred shaped member and a distal lateral side of the barred shaped member.

18. The method of claim 17, wherein the barred shaped member is molded to have a total of five bars and six openings.

* * * * *